US005098511A

United States Patent [19]

Barnes

[11] Patent Number: 5,098,511

[45] Date of Patent: Mar. 24, 1992

[54] FLEXIBLE GUIDE FOR FOLDED, MOISTENED DOCUMENTS

[75] Inventor: Robert J. Barnes, Southbury, Conn.

[73] Assignee: Pitney Bowes Inc., Stamford, Conn.

[21] Appl. No.: 384,525

[22] Filed: Jul. 25, 1989

[51] Int. Cl.[5] ..... B31F 1/00

[52] U.S. Cl. ..... 156/442.1; 156/442.2; 156/443; 100/211; 226/198; 271/2

[58] Field of Search ..... 100/211; 198/798, 836; 226/196, 198, 199; 156/441.5, 442.1, 442.2, 443; 271/2, 220, 229; 493/442, 443, 445, 446, 447, 448

[56] References Cited

U.S. PATENT DOCUMENTS

| | | | |
|---|---|---|---|
| 1,962,713 | 6/1934 | Griffith | 198/836 X |
| 2,221,236 | 11/1940 | Gay | 198/836 |
| 4,799,989 | 1/1989 | Marzullo | 156/443 X |
| 4,851,119 | 7/1989 | Berglöff et al. | 100/211 X |
| 4,875,965 | 10/1989 | Marzullo | 156/443 X |

FOREIGN PATENT DOCUMENTS

| | | | |
|---|---|---|---|
| 420520 | 8/1974 | U.S.S.R. | 198/836 |

*Primary Examiner*—Michael W. Ball
*Assistant Examiner*—Mark A. Osele
*Attorney, Agent, or Firm*—Charles R. Malandra, Jr.; David E. Pitchenik; Melvin J. Scolnick

[57] ABSTRACT

Apparatus for folding, sealing and aligning seriatim a supply of documents into envelopes, each of the documents containing a water-activated adhesive on a portion thereof. The apparatus includes: a hopper for storing a supply of the documents; a device for applying moisture to a portion of the documents; a pair of folding rollers for imparting a fold to the documents; a buckle chute for stopping the forward progress of the documents and causing the documents to enter the nip of the folding rollers; a pair of ironing rollers located downstream of the folding rollers for maximizing adhesive contact of the documents and forming the envelopes; a conveying device located downstream of the ironing rollers for holding the envelopes together during transport prior to their release for further processing; and a downwardly billowing, flexible membrane situated above the conveying device. The membrane is contiguous with a portion of the conveying device, whereby the membrane is able to contact the envelopes as the envelopes are moved by the conveying device and where the alignment of the moving envelopes is maintained.

7 Claims, 4 Drawing Sheets

FLEXIBLE GUIDE FOR FOLDED, MOISTENED DOCUMENTS

BACKGROUND OF THE INVENTION

The instant invention relates to document sheets containing a water-activated adhesive that are folded and sealed in a manner that they become converted into sealed document/envelopes which can be mailed by themselves without being inserted into another envelope and which when opened constitute a self-contained document. More particularly, the instant invention relates to apparatus for folding and sealing such document sheets.

Millions of business correspondence forms are utilized in commerce and the like, such as billing invoices, delivery notification, and the like. At the present time, multi-sheet business forms, some utilizing carbon paper or other means of duplication, are sold by manufacturers and delivered to the users. The forms are removed from their shipping container and inserted in a typewriter or printer which may be operated by a computer. The billing information or the like may be fed into a computer system which operates the typewriter or printer, to place the desired billing information on the forms. Each form may differ in its information, in that the typewriter or printer will insert a different customer with a different address, and a different billing amount (or other information) for each form.

In the above prior art systems, it is necessary for the forms to carry severable, lateral side strips having holes into which the pins of a form feeding sprocket fit, so that there is precise control of the position of the data entered onto the various layers of the business form, which is typically pre-printed. The pre-printed portions must of course be in precise registration with the material which is added by the computerized typewriter or printer.

After the desired information has been entered by the computerized typewriter or printer, the forms are manually severed from each other, and the side strips with holes are removed. The forms may then be placed in an envelope.

The amount of paper in the side strips generally constitutes approximately 10 percent of the entire paper used in the forms, and thus constitutes a significant waste of paper, since the side strips are discarded. Furthermore, a considerable amount of manual labor is necessary to remove the forms from the typewriter or printer, to separate the forms and insert them into envelopes. Additionally, a significant amount of waste and delay is encountered by the simple step of shipping the blank business forms to the processor, involving the added expense of packaging materials and shipping expenses.

In response to the foregoing problems, a process has been developed for the production of message-containing envelopes in which the message may differ. Because the lateral, removable, perforated portions for alignment are unnecessary, there is a substantial savings in paper. The end product of this process constitutes a sealed, addressed envelope, ready for mailing. In U.S. Pat. No. 4,799,989 issued to the assignee of the instant invention on Jan. 24, 1989, apparatus is disclosed for folding and sealing seriatim a supply of documents into envelopes, each of the documents containing water-activated adhesive on at least one portion thereof. The apparatus comprises a hopper for storing a supply of the documents, means for applying moisture to a portion of the documents, and a pair of folding rollers for imparting a fold to the documents. The apparatus further includes a buckle chute for stopping the forward progress of the documents and causing the documents to enter the nip of the folding rollers, and means mounted on the buckle chute for applying moisture to an interior portion of the documents. In copending application Ser. No. 115,220 filed Oct. 30, 1987 by the assignee of the instant invention entitled "Apparatus for Folding and Sealing Documents", there is additionally disclosed for use with the foregoing apparatus a pair of ironing rollers located downstream of the folding rollers for maximizing adhesive contact of the documents and forming the envelope, and conveying/curing means located downstream of the ironing rollers for holding the envelopes together during transport prior to their release for further processing.

When the formed envelope emerges from the ironing rollers, in many cases it will be rumpled rather than perfectly flat, which creates problems for the further processing required for the envelope. A common requirement for further processing is that the envelopes be aligned parallel to each other, and rumpled envelopes derogate from the ability to align the envelopes. Several approaches were attempted in order to achieve the proper alignment of the moistened envelopes and none proved successful. Some approaches would work with one size of envelope but not another. The instant invention proved to be the only apparatus that would reliably align all sizes of moistened envelopes emerging from the ironing rollers.

SUMMARY OF THE INVENTION

Accordingly, the instant invention provides apparatus for folding, sealing and aligning seriatim a supply of documents into envelopes, each of the documents containing a water-activated adhesive on a portion thereof. The apparatus includes: a hopper for storing a supply of the documents; a device for applying moisture to a portion of the documents; a pair of folding rollers for imparting a fold to the documents; a buckle chute for stopping the forward progress of the documents and causing the documents to enter the nip of the folding rollers; a pair of ironing rollers located downstream of the folding rollers for maximizing adhesive contact of the documents and forming the envelopes; a conveying device located downstream of the ironing rollers for holding the envelopes together during transport prior to their release for further processing; and a downwardly billowing, flexible membrane situated above the conveying device. The membrane is contiguous with a portion of the conveying device, whereby the membrane is able to contact the envelopes as the envelopes are moved by the conveying device and whereby the alignment of the moving envelopes is maintained.

DESCRIPTION OF THE PREFERRED EMBODIMENT

Figure 1:
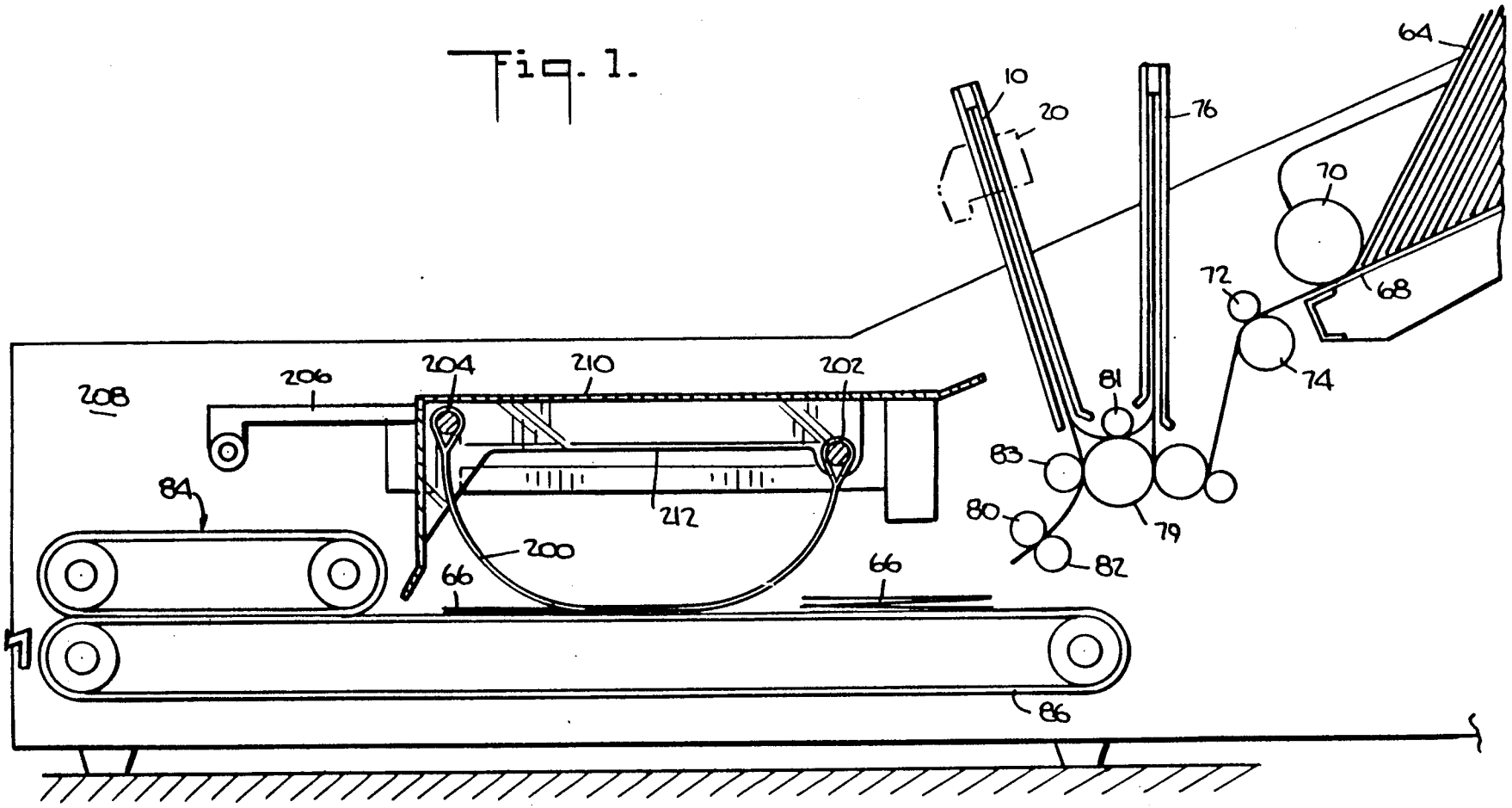
FIG. 1 is a schematic, side elevational view of apparatus for folding and sealing documents employing an aligning, flexible membrane module in accordance with the instant invention.
Figure 2:
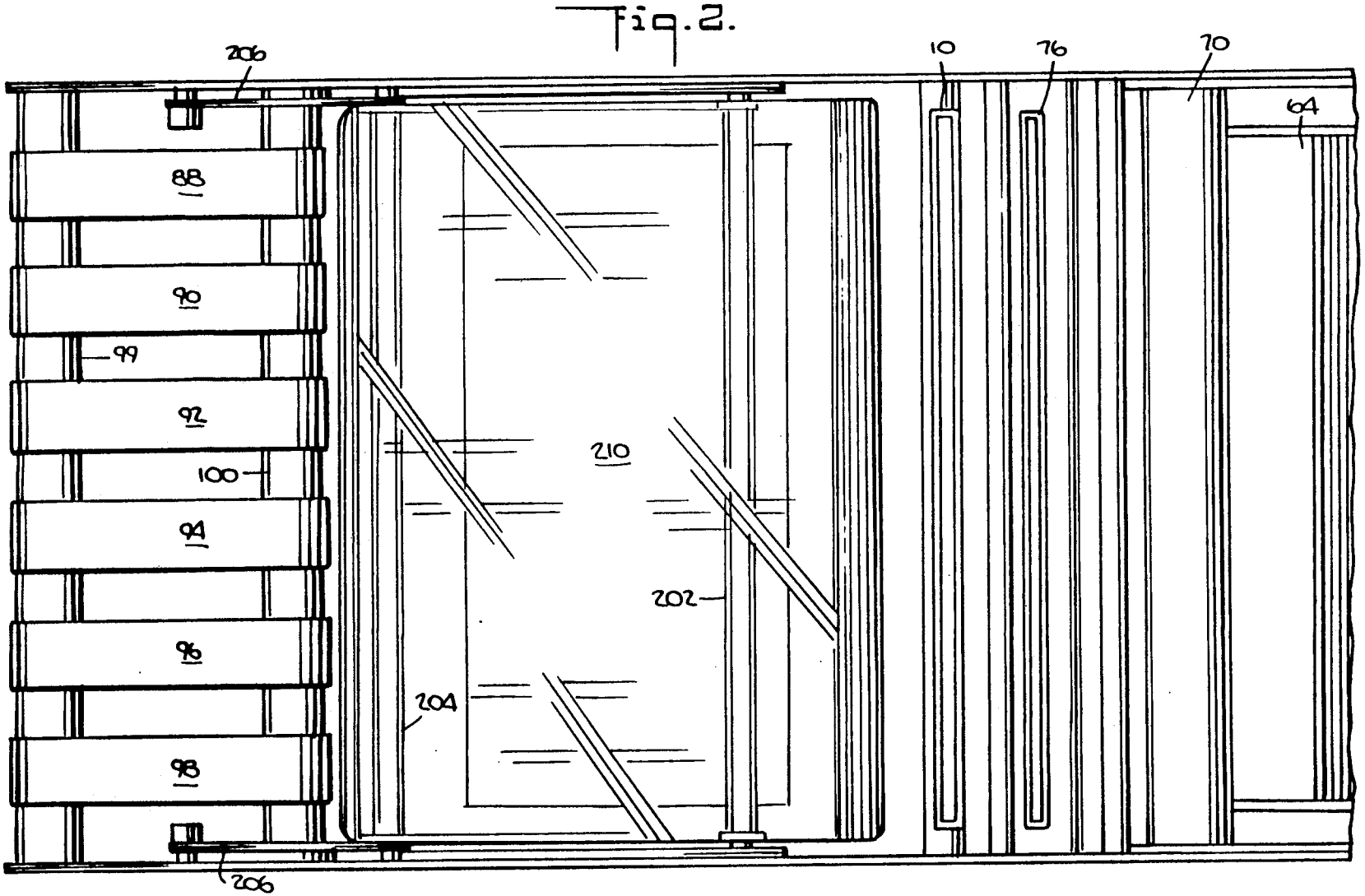
FIG. 2 is a top, plan view of the apparatus seen in FIG. 1.
Figure 3:
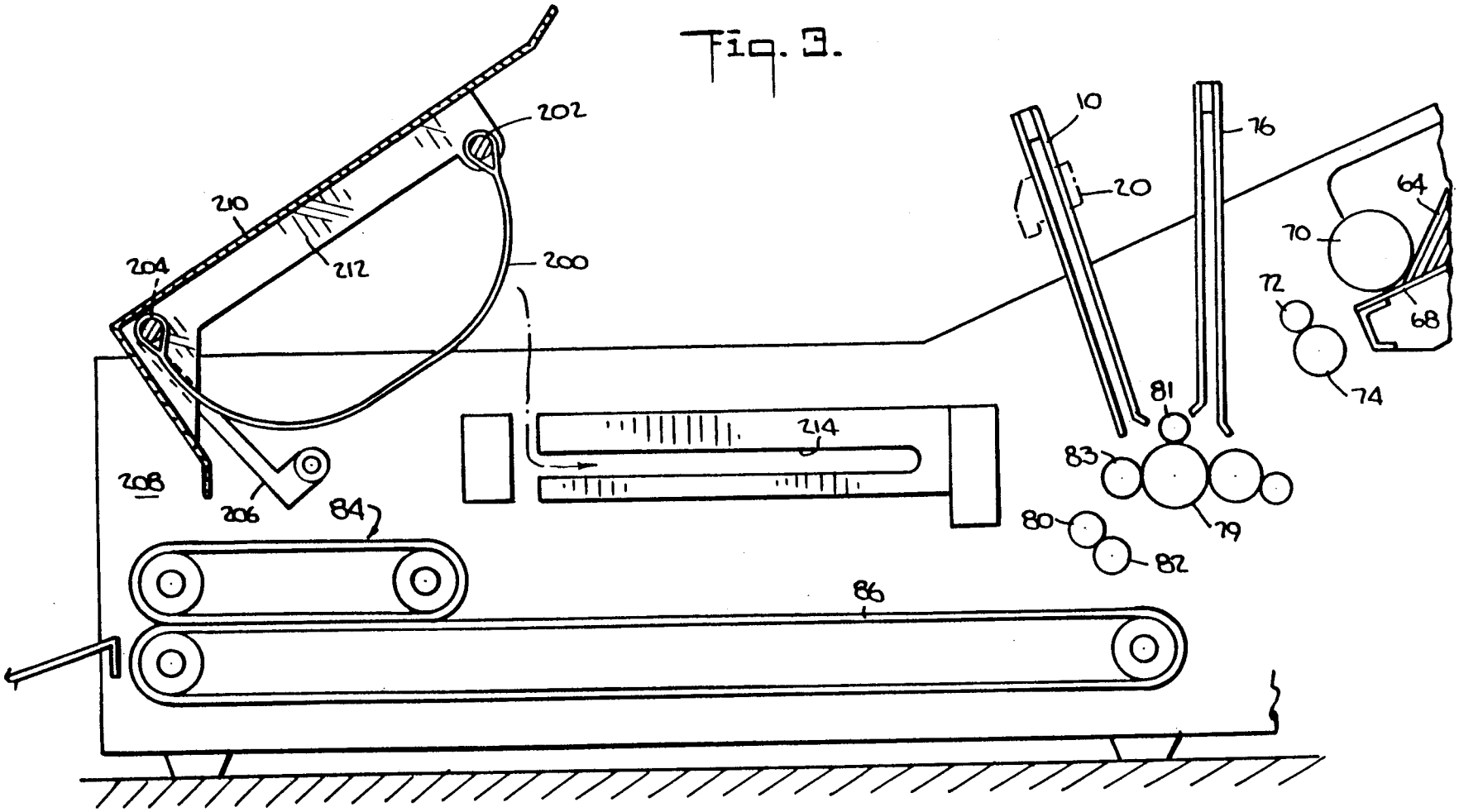
FIG. 3 is similar to FIG. 1 except that the flexible membrane is shown in its elevated, open position for facilitating clearance of paper jams.
Figure 4:
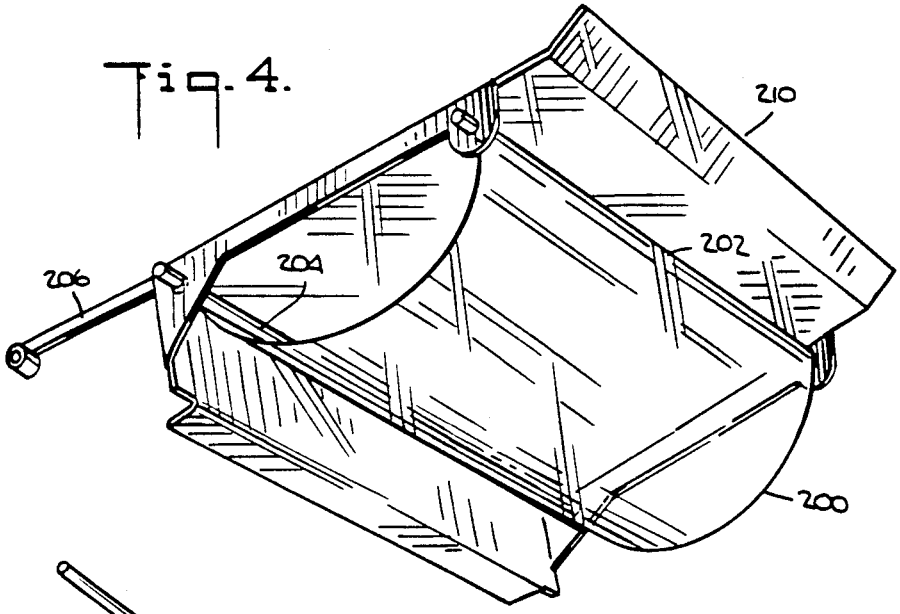
FIG. 4 is a perspective view of the flexible membrane module seen in FIGS. 1-3.
Figure 5:
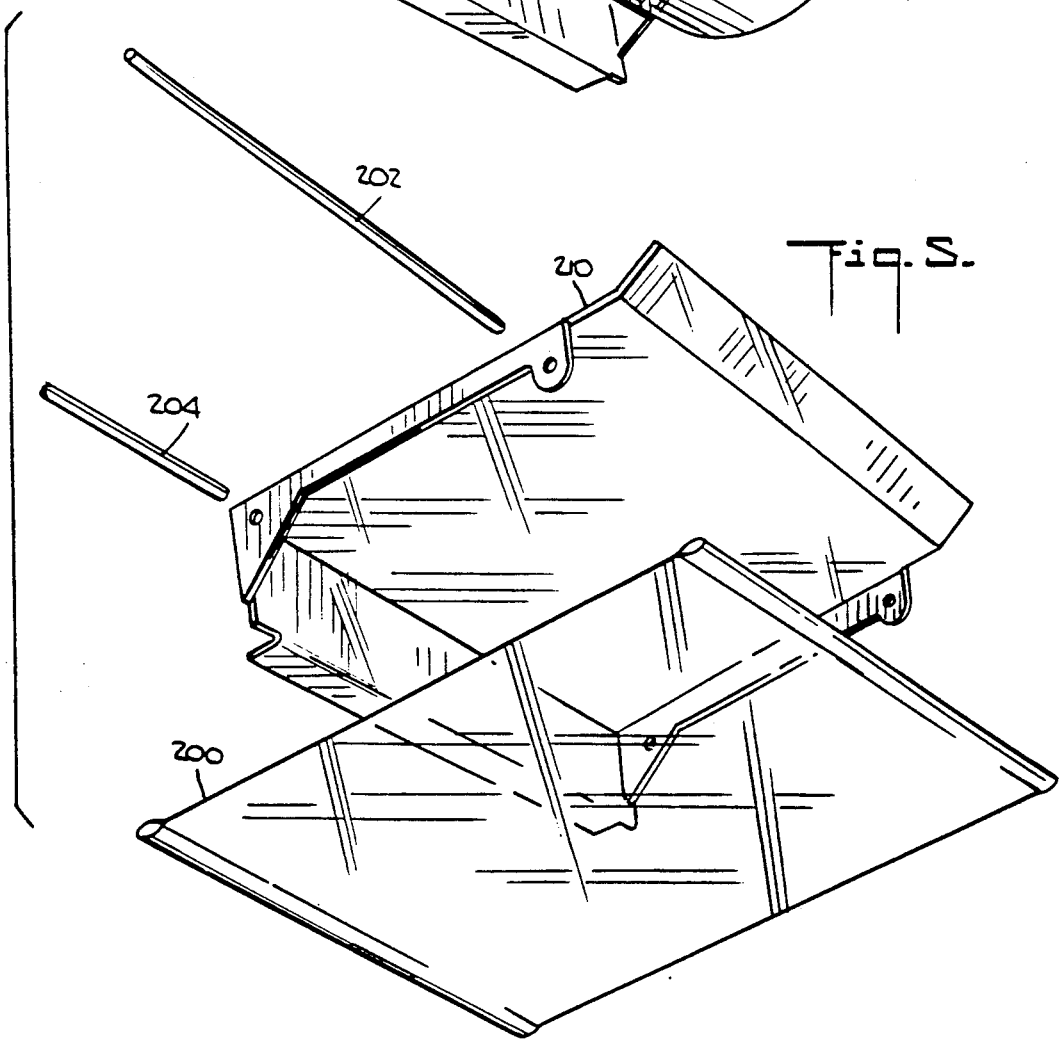
FIG. 5 is an exploded, perspective view showing the elements forming the module shown in FIG. 4.

In describing the preferred embodiment of the instant invention, reference is made to the drawings, wherein there is seen in FIGS. 1-3 an inclined hopper 68 containing a plurality of documents having water-activated adhesive portions therein. The documents 64 are fed by means of feeder rollers 70, 72 and 74 toward a first buckle chute 76 if two folds are desired and then to a second buckle chute 10. If only one fold is needed, the first buckle chute 76 is bypassed. The folds are effected by feed rollers 79, 81 and 83. A moistening device 20 is secured to the second buckle chute 10 as set forth in the aforesaid U.S. Pat. No. 4,799,989 issued Jan. 24, 1989, the entirety of which is hereby incorporated by reference. The moistening device 20 is used to apply moisture to either the adhesive portions of the documents 64 or areas of the document 64 lacking such adhesive but which are later brought into contact with such adhesive containing areas.

A pair of ironing rollers 80 and 82 are located downstream of the buckle chute 10 for assuring maximum adhesive contact of the newly formed envelope 66, which is then fed downstream to a conveyor/curing station 84 which holds the newly formed envelope 66 firmly together to allow the adhesive to set and achieve optimum holding force before its release to an accumulation area (not shown) downstream.

The conveyor/curing station 84 consists of a lower conveyor belt 86 extending across the width of the station 84 and six upper belts 88, 90, 92, 94, 96 and 98 rotatable mounted on shafts 99 and 100. The belts 88, 90, 92, 94, 96 and 98 move at a substantially slower speed than the ironing rollers 80 and 82 to thereby cause the envelopes 66 to be shingled, i.e. partially overlap one another, thereby facilitating downstream stacking.

Downstream of the ironing rollers 80 and 82 and situated above the conveyor belt 86 is a downwardly billowing, flexible sheet of acetate 200 suspended at its upstream and downstream ends about shafts 202 and 204 respectively. The shaft 204 is mounted at the ends of a pair of bracket arms 206 (see FIG. 3) which are rotatably mounted in the side panels 208 of the conveyor/-curing station 84. Pivotably mounted on the shaft 204 is a rigid, protective sheath 210. The upstream shaft 202 is supported in the side flanges 212 of the sheath 210. A pair of guide slots 214 are situated in the side panels 208 and receive the end portions of the shaft 202.

As best seen in FIG. 3, the flexible membrane or sheet 200 can be retracted in order to clear james in the conveyor/curing station 84 by simply grasping the protective sheath 210 and sliding it upstream away from the ironing rollers 80 and 82. The slots 214 in the side panels 208 permit the end portions of the shaft 202 to translate in the direction of movement away from the rollers 80 and 82.

In operation, when the newly formed envelopes 66 emerge from the ironing rollers 80 and 82 after having been formed by the moistening device 20 and associated apparatus, they are dumped onto the conveyor belt 86. It is at this point that the acetate sheet 200 functions as a guide to maintain the alignment of the deposited envelopes 66. The particular shape of the sheet 200 and the flexibility provided by its attachment to the shafts 202 and 204 allows the sheet 200 to be used for varying widths and lengths of envelopes 66 without any adjustment being required.

It should be understood by those skilled in the art that various modifications may be made in the present invention without departing from the spirit and scope thereof, as described in the specification and defined in the appended claims.

What is claimed is:

1. Apparatus for folding, sealing and aligning seriatim a supply of documents into envelopes, each of said documents containing a water-activated adhesive on a portion thereof, comprising:
   - a hopper for storing a supply of said documents;
   - means for applying moisture to said portion of the documents;
   - a pair of folding rollers for imparting a fold to said documents;
   - a buckle chute for stopping the forward progress of said documents and causing said documents to enter the nip of said folding rollers;
   - a pair of ironing rollers located downstream of said folding rollers for maximizing adhesive contact of said documents and forming the envelopes;
   - conveying means located downstream of said ironing rollers for holding said envelopes together during transport prior to their release for further processing; and
   - a downwardly billowing, flexible membrane situated above said conveying means, said membrane being contiguous with a portion of said conveying means, whereby said membrane is able to contact said envelopes as said envelopes are moved by said conveying means and whereby the alignment of said moving envelopes is maintained.

2. The apparatus of claim 1, wherein said moisture applying means is mounted on said buckle chute.

3. The apparatus of claim 1 wherein said flexible membrane comprises acetate.

4. The apparatus of claim 1, wherein said conveying means comprises a plurality of upper and lower conveyor belts.

5. The apparatus of claim 1, additionally comprising a pair of shafts secured to said conveying means, and wherein said membrane is suspended at its upstream and downstream ends about said shafts.

6. The apparatus of claim 5, wherein said membrane comprises acetate.

7. The apparatus of claim 5 wherein said membrane is retractable from said conveying means for clearing jams of said envelopes occurring at said conveying means.

* * * * *